US008651083B2

(12) United States Patent
Izawa et al.

(10) Patent No.: US 8,651,083 B2
(45) Date of Patent: Feb. 18, 2014

(54) CYLINDER BLOCK AND THERMALLY SPRAYED COATING FORMING METHOD

(75) Inventors: Yoshinori Izawa, Yokohama (JP); Akira Shimizu, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 119 days.

(21) Appl. No.: 13/201,741

(22) PCT Filed: Feb. 19, 2010

(86) PCT No.: PCT/IB2010/000327

§ 371 (c)(1),
(2), (4) Date: Aug. 16, 2011

(87) PCT Pub. No.: WO2010/100533

PCT Pub. Date: Sep. 10, 2010

(65) Prior Publication Data

US 2011/0297118 A1 Dec. 8, 2011

(30) Foreign Application Priority Data

Mar. 4, 2009 (JP) ..... 2009-051012

(51) Int. Cl.
*F02F 1/00* (2006.01)
*C23C 4/12* (2006.01)

(52) U.S. Cl.
USPC ..... 123/193.2; 123/668

(58) Field of Classification Search
USPC ..... 123/193.2, 668; 427/453–455, 469; 428/469
See application file for complete search history.

(56) References Cited

U.S. PATENT DOCUMENTS 4,706,616 A 11/1987 Yoshimitsu
5,592,927 A 1/1997 Zaluzec et al.

(Continued)

FOREIGN PATENT DOCUMENTS

CN 1978696 A 6/2007
JP 61-087859 A 5/1986

(Continued)

OTHER PUBLICATIONS

An English translation of the Russian Decision on Grant of corresponding Russian Application No. 2011140149, issued on Jan. 28, 2013.

(Continued)

*Primary Examiner* — M. McMahon
(74) *Attorney, Agent, or Firm* — Global IP Counselors, LLP

(57) ABSTRACT

A cylinder block is provided with a cylinder bore and a thermally sprayed metallic coating disposed on an internal wall of the cylinder bore. The internal wall has first and second wall sections that are located at different axial locations along the internal wall of the cylinder bore. The thermally sprayed metallic coating is disposed on the internal wall of the cylinder bore by spraying droplets of a molten metal. The thermally sprayed metallic coating includes a first thermally sprayed coating portion having a first iron oxide concentration and a second thermally sprayed coating portion having a second iron oxide concentration. The first thermally sprayed coating portion is disposed on the first wall section. The second thermally sprayed coating portion is disposed on the second wall section. The second iron oxide concentration is different from the first iron oxide concentration.

13 Claims, 4 Drawing Sheets

(56) References Cited

U.S. PATENT DOCUMENTS

| | | | | |
|---|---|---|---|---|
| 6,187,388 | B1 * | 2/2001 | Popoola et al. | 427/455 |
| 6,395,090 | B1 * | 5/2002 | Shepley et al. | 118/504 |
| 7,081,276 | B2 * | 7/2006 | Miyamoto et al. | 427/455 |
| 2002/0051851 | A1 | 5/2002 | Barbezat | |
| 2003/0152698 | A1 * | 8/2003 | Smith et al. | 427/236 |
| 2004/0226402 | A1 * | 11/2004 | Fuchs et al. | 74/828 |
| 2005/0214540 | A1 * | 9/2005 | Maslar | 428/408 |
| 2007/0099015 | A1 * | 5/2007 | Kamo et al. | 428/469 |
| 2009/0104348 | A1 * | 4/2009 | Terada et al. | 427/236 |

FOREIGN PATENT DOCUMENTS

| | | | |
|---|---|---|---|
| JP | 2000-212717 | A | 11/2005 |
| JP | 2007-016737 | A | 1/2007 |
| JP | 2007-508147 | A | 4/2007 |
| JP | 2007-302941 | A | 11/2007 |
| KR | 10-2003-0071507 | A | 9/2003 |
| RU | 2281983 | C2 | 8/2006 |

OTHER PUBLICATIONS

An English translation of the Chinese Notification of Opinion of corresponding Chinese Application No. 2010800076871, issued on Jan. 14, 2013.

The extended European Search Report for the corresponding European Patent Application No. 10748392.7-1215 dated Aug. 2, 2012.

A Written Opinion of the International Search Authority for International Application No. PCT/IB2010/000327, dated Apr. 5, 2010, mailed Apr. 13, 2010.

An English translation of the Russian Office Action of corresponding Russian Application No. 2011140149, issued on Nov. 9, 2012.

An English translation of the Korean Notification of Filing of Argument of corresponding Korean Application No. 10-2011-7020241, issued on Apr. 9, 2013.

* cited by examiner

CYLINDER BLOCK AND THERMALLY SPRAYED COATING FORMING METHOD

CROSS-REFERENCE TO RELATED APPLICATIONS

This application is a U.S. National stage of International Application No. PCT/IB2010/000327, filed Feb. 19, 2010, which claims priority to Japanese Patent Application No. 2009-051012, filed on Mar. 4, 2009. The entire disclosure of Japanese Patent Application No. 2009-051012 is hereby incorporated herein by reference.

BACKGROUND

1. Field of the Invention

The present invention generally relates to a cylinder block having a thermally sprayed coating formed on an internal wall of a cylinder bore and a method of forming the thermally sprayed coating. More specifically, the present invention relates to a cylinder block having a thermally sprayed coating formed on a cylinder bore of the cylinder block in which the thermally sprayed coating has improved performance characteristics required by respective sections of a cylinder bore.

2. Background Information

U.S. Pat. No. 5,592,927 discloses a technology for forming a thermally sprayed coating on an internal wall of a cylinder bore of an aluminum alloy cylinder block as a cylinder liner. The thermally sprayed coating serves as an alternative to a conventional cast iron cylinder liner. The thermally sprayed coating is made by atomizing droplets of a molten metal material and spraying the molten metal material onto the internal wall of the cylinder bore.

SUMMARY

It has been discovered that in a section of the cylinder bore near the combustion chamber, excellent adhesion of the thermally sprayed coating with respect to the internal wall surface is required because that section of the cylinder bore is subjected to high temperatures. Meanwhile, in a section of the cylinder bore where the piston moves in a sliding fashion, the thermally sprayed coating needs to have excellent sliding performance with respect to the piston. Thus, the thermally sprayed coating needs to be strongly affixed to the internal wall surface of the cylinder bore in a vicinity of the combustion chamber, and the thermally sprayed coating needs to have a low frictional resistance with respect to the piston in a section of the cylinder bore where the piston slides.

However, with the thermal spraying technology presented in the aforementioned patent document, the thermally sprayed coating is formed with uniform properties over the entire internal surface of the cylinder bore (i.e., the hardness, adhesion strength, porosity and other properties of the coating are uniform). Consequently, the coating is not able to satisfy both of the requirements described above.

One object of the present invention is to provide a cylinder block having a thermally sprayed coating that satisfies the performance characteristics required by the respective sections of the cylinder bore. Another object of the present invention is to provide a method of forming the thermally sprayed coating.

In view of the state of the known technology, one aspect of the present invention is to provide a cylinder block that mainly comprising a cylinder bore and a thermally sprayed metallic coating disposed on an internal wall of the cylinder bore. The internal wall has a first wall section and a second wall section. The first and second wall sections are located at different axial locations along the internal wall of the cylinder bore. The thermally sprayed metallic coating is disposed on the internal wall of the cylinder bore by spraying droplets of a molten metal. The thermally sprayed metallic coating includes a first thermally sprayed coating portion having a first iron oxide concentration and a second thermally sprayed coating portion having a second iron oxide concentration. The first thermally sprayed coating portion is disposed on the first wall section of the internal wall of the cylinder bore. The second thermally sprayed coating portion is disposed on the second wall section of the internal wall of the cylinder bore. The second iron oxide concentration is different from the first iron oxide concentration.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
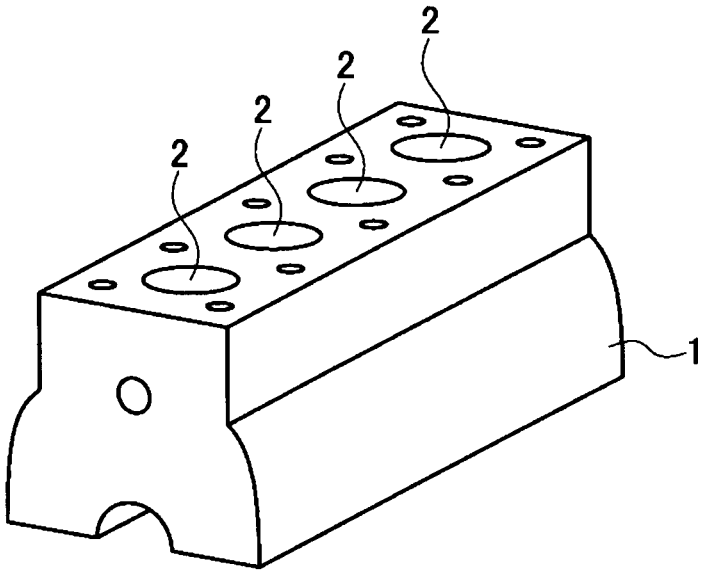
FIG. 1 is a perspective view of a cylinder block on which a thermally sprayed coating is formed on accordance with one embodiment.

Referring initially to FIG. 1, an engine cylinder block 1 is illustrated on which thermally sprayed coatings are formed in accordance with one illustrated embodiment. As seen in FIG. 1, the engine cylinder block 1 has a plurality of cylinder bores 2. A thermally sprayed coating 3 is formed on an internal wall of each of the cylinder bores 2. The cylinder block 1 is not a conventional iron cylinder block but, instead, is cast using an aluminum alloy to achieve a lighter weight. Cylindrical holes, i.e., cylinder bores 2, are formed in the cylinder block 1 to house pistons. Also as used herein to describe the engine cylinder block 1, the following directional terms "lower", "upper", "above", "downward", "vertical", "horizontal", "below" and "transverse" as well as any other similar directional terms refer to those directions of the cylinder bore 2 with the center axis of the cylinder bore 2 disposed in a vertical orientation. Accordingly, these terms, as utilized to describe the engine cylinder block 1 should be interpreted relative to the center axis of the cylinder bore 2 being disposed in a vertical orientation.

Figure 2:
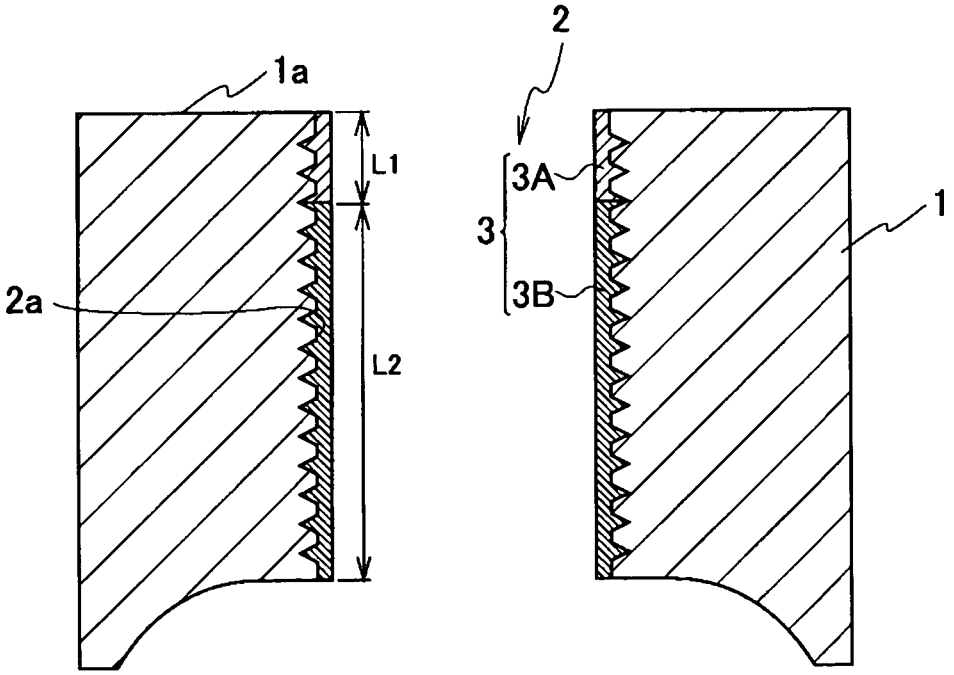
FIG. 2 is an enlarged, simplified cross sectional view of an internal wall of a cylinder bore of the cylinder block shown in FIG. 1 showing important features of the thermally sprayed coating.

Now referring to FIG. 2, an enlarged cross sectional view of an internal wall of one of the cylinder bores 2 of the cylinder block 1 shown in FIG. 1 is illustrated to show features of the thermally, sprayed coating 3. The thermally sprayed 3 coating is formed by spraying droplets of molten metal. As shown in FIG. 2, each thermally sprayed coating 3 comprises a first thermally sprayed coating portion 3A and a second thermally sprayed coating portion 3B. The first thermally sprayed coating portion 3A is formed on a first wall section of the cylinder bore 2 that is near a combustion chamber formed in a cylinder head (not shown) (i.e., near an upper entrance of the cylinder bore 2). The first thermally sprayed coating portion 3A is formed with a first iron oxide concentration. The second thermally sprayed coating portion 3B is formed on a second wall section of the inside of the cylinder bore 2 where a piston moves reciprocally up and down in a sliding motion. The second thermally sprayed coating portion 3B is formed with a second iron oxide concentration. The concentration of an iron oxide contained in the first thermally sprayed coating portion 3A is different from the concentration of the iron oxide contained in the second thermally sprayed coating portion 3B. In other words, the first iron oxide concentration of the first thermally sprayed coating portion 3A is different from the second iron oxide concentration of the second thermally sprayed coating portion 3B. Thus, the thermally sprayed coating 3 has a different iron oxide concentration in at least two different wall sections of the cylinder bore 2.

The second wall section of the inside of the cylinder bore 2 where a piston moves reciprocally up and down in a sliding motion. The second wall section will hereinafter be called the sliding section. The sliding section is defined to be a section encompassing the entire cylinder bore 2, except for a section that includes top dead center (section near an upper entrance of the cylinder bore 2, i.e., near a combustion chamber), where the speed of the piston slows. Although the speed of the piston also slows at bottom dead center, a section that includes bottom dead center is not excluded from the sliding section.

The surface of the internal wall 2*a* of the cylinder bore 2 is finely roughened so that the molten droplets forming the thermally sprayed coating 3 will enter into the indentations of the roughened surface, thereby increasing the adhesion strength of the thermally sprayed coating 3 with respect to the internal wall 2*a* of the cylinder bore 2. The first thermally sprayed coating portion 3A is formed on a first wall section that extends a prescribed distance L1 from an upper opening of the cylinder bore 2 (near a combustion chamber) downward. Thus, the first thermally sprayed coating portion 3A is formed from an entrance of the cylinder bore 2 that is located at an upper surface 1*a* of the cylinder block to a position inside the cylinder bore 2 that is located a distance L1 (e.g., 40 mm) from the upper surface 1*a*. This prescribed distance L1 is also called a first thermally sprayed coating formation region length L1. The second thermally sprayed coating portion 3B is formed over a prescribed distance L2 from a bottom position of the first thermally sprayed coating portion 3A. Thus, for example, the second thermally sprayed coating portion 3B is formed over the distance L2 downward from a position located 40 mm from the entrance opening of the cylinder bore 2. This prescribed distance L1 is also called a second thermally sprayed coating formation region length L2.

The first wall section (i.e., where the first thermally sprayed coating portion 3A is formed) is subjected to high temperatures because it is close to the combustion chamber. Consequently, the first thermally sprayed coating portion 3A needs to have a high inter-layer adhesion strength with respect to the internal wall 2*a* as compared to the second thermally sprayed coating portion 3B of the sliding section. In order to increase the adhesion strength, the first thermally sprayed coating portion 3A is made such that the concentration of an iron oxide contained in the coating is comparatively low in comparison to the second thermally sprayed coating portion 3B of the sliding section. Lowering the concentration of the iron oxide contained in the thermally sprayed coating increases the inter-layer adhesion strength of the coating with respect to the internal wall 2*a*, thereby enabling an anti-knock property of the engine during combustion to be improved.

The sliding section where the second thermally sprayed coating portion 3B is formed is subjected to a piston moving reciprocally at higher speeds than near the combustion chamber. Consequently, the second thermally sprayed coating portion 3B needs to have a better sliding performance such that the piston can slide smoothly. In order achieve a better sliding performance with respect to the piston, the second thermally sprayed coating portion 3B is made such that the concentration of an iron oxide contained in the coating is comparatively high in comparison to the first thermally sprayed coating portion 3A of the first wall section. Increasing the concentration of the iron oxide in the thermally sprayed coating enables a self-lubricating property of the iron oxide to improve the sliding performance of the coating.

In the cylinder block 1 described above, the thermally sprayed coating 3 formed on the internal wall 2*a* of the cylinder bore 2 is formed such that a concentration of an iron oxide contained in the coating is different depending on a section of the internal wall 2*a* of the cylinder bore 2. As a result, each wall section can be endowed with certain properties (i.e., inter-layer adhesion strength and sliding performance) in accordance with the iron oxide concentration.

In the cylinder block 1 described above, the iron oxide concentration contained in the second thermally sprayed coating portion 3B that is formed on the sliding section of the cylinder bore 2*a* where the piston slides is higher than the iron oxide concentration contained in the first thermally sprayed coating portion 3A formed on the first wall section of the cylinder bore 2 near a combustion chamber. Thus, the sliding performance of the thermally sprayed coating 3 with respect to the piston can be improved due to the self-lubricating property of the iron oxide.

In the cylinder block 1 according to this embodiment, an anti-knocking property of the engine can be ensured at the first wall section of the cylinder bore 2 near the combustion chamber and an wear resistance property with respect to a piston can be increased in the sliding section of the cylinder bore 2. In this way, with the cylinder block 1 according to the first embodiment, each section of the cylinder bore 2 can be made to satisfy different performance requirements.

Figure 3:
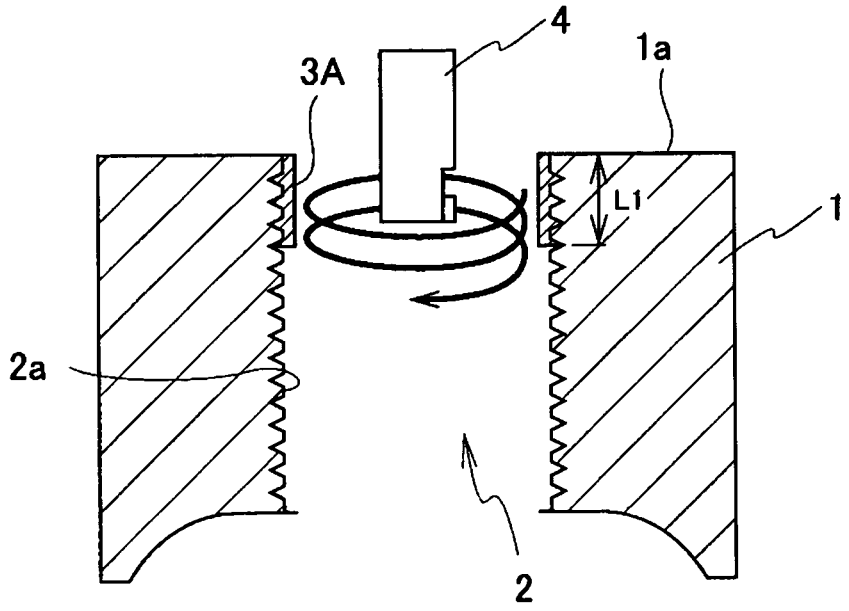
FIG. 3 is an enlarged, simplified cross sectional view of one of the cylinder bores of the cylinder block shown in FIG. 1 showing a first part of a process of forming a thermally sprayed coating on a first wall section of a cylinder bore in a vicinity of a combustion chamber.
Figure 4:
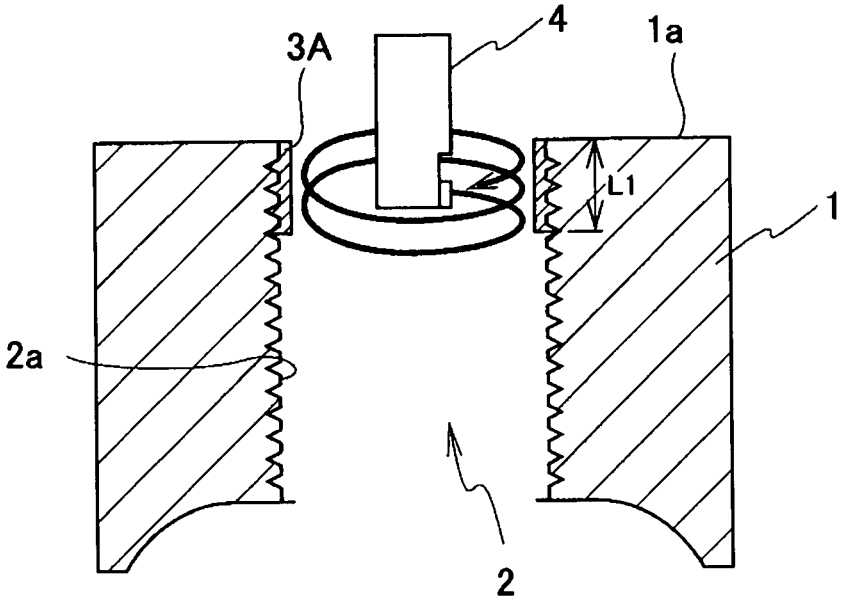
FIG. 4 is an enlarged, simplified cross sectional view of the cylinder bore of shown in FIG. 3 showing a second part of a process of forming a thermally sprayed coating on the first wall section of the cylinder bore in the vicinity of the combustion chamber.
Figure 5:
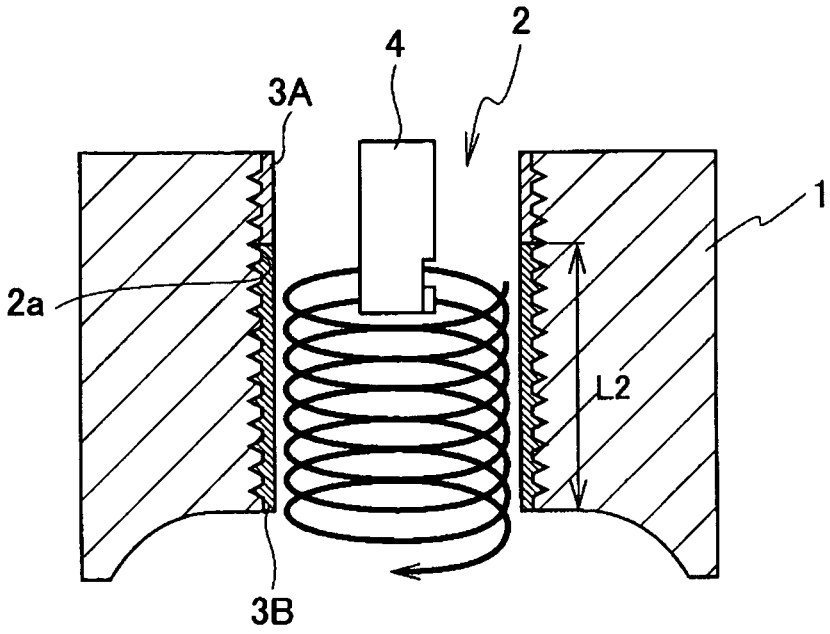
FIG. 5 is an enlarged, simplified cross sectional view of the cylinder bore of shown in FIG. 4 showing a first part of a process of forming a thermally sprayed coating on a second wall section of the cylinder bore in a section of the cylinder bore where a piston slides.
Figure 6:
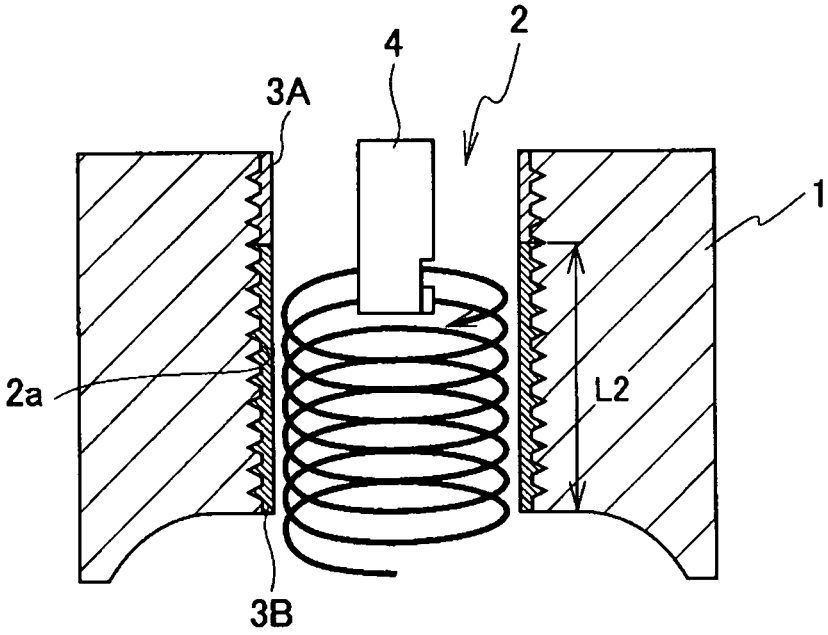
FIG. 6 is an enlarged, simplified cross sectional view of the cylinder bore of shown in FIG. 5 showing a second part of a process of forming a thermally sprayed coating on the second wall section of the cylinder bore in the section of the cylinder bore where the piston slides.

A thermally sprayed coating forming method for forming the thermally sprayed coating 3 on the internal wall 2*a* of the cylinder bore 2 of the cylinder block 1 will now be explained with reference to FIGS. 3 to 6. FIGS. 3 and 4 illustrate a process of forming a thermally sprayed coating on the first wall section of the cylinder bore 2 in a vicinity of a combustion chamber, while FIGS. 5 and 6 illustrate a process of forming a thermally sprayed coating on the second wall or sliding section of the cylinder bore 2 where a piston slides.

Before forming the thermally sprayed coating 3 on the inside wall surfaces 2*a* of the cylinder bores 2, outside surfaces of the cylinder block 1 are treated to remove burrs and other surface imperfections remaining after casting. Then, the internal walls 2*a* of the cylinder bores 2 are treated with a bore surface preparatory machining process to achieve a finely roughened surface. The bore surface preparatory machining process serves to form fine indentations and protrusions on the surface of the internal walls 2*a* of the cylinder bores 2 so and thereby increase the adhesion strength of the thermally sprayed coating 3 with respect to the internal walls 2*a*.

The internal wall 2*a* of each cylinder bore 2 is divided into an upper wall section and a lower wall section. Droplets of a molten metal are sprayed onto the respective sections to form the thermally sprayed coating 3. More specifically, as mentioned previously, the internal wall 2*a* of each cylinder bore 2 is divided into two wall sections: the first wall section near a combustion chamber and the second wall (sliding) section where a piston slides. The content of an iron oxide contained in the portion of the thermally sprayed coating 3 formed on the section of the cylinder bore 2 near the combustion chamber is different from the content of the iron oxide contained in the portion of the thermally sprayed coating 3 formed on the sliding section of the cylinder bore 2. The content of iron oxide contained in each portion of the thermally sprayed coating 3 is varied by changing a feed stroke length of a nozzle 4 that is used to spray the molten droplets. Specifically, the feed stroke length used for the first wall section near the combustion chamber is different from the feed stroke used for the sliding section such that the second iron oxide concentration of the sliding section is higher than the first iron oxide concentration of the first wall section near the combustion chamber.

First, the first wall section of the cylinder bore 2 near the combustion chamber is sprayed. More specifically, as shown in FIG. 3, the nozzle 4 of a thermal spray gun apparatus is inserted inside the cylinder bore 2 and droplets of molten metal are sprayed from a tip end of the nozzle 4 while the nozzle 4 is rotated about an axis in the direction indicated with an arrow and lowered downward into the cylinder bore 2 from the entrance opening of the cylinder bore 2. The molten metal is, for example, an iron based material.

As seen in FIG. 3, molten metal droplets is sprayed onto the first wall section of the internal wall 2*a* near the combustion chamber while the nozzle 4 is simultaneously rotated and lowered downward into the cylinder bore 2 from the entrance opening of the cylinder bore 2. As seen in FIG. 4, when the nozzle 4 reaches a bottom end position of the first wall section near the combustion chamber, the feed direction of the nozzle 4 is reversed and molten metal droplets are sprayed onto the internal wall 2*a* while the nozzle 4 is simultaneously rotated and raised upward toward the entrance opening of the cylinder bore 2.

In this embodiment, if the first thermally sprayed coating formation region length L1 is 40 mm, then the stroke length through which the nozzle 4 is lowered and raised is set 20 to 25 mm. The first thermally sprayed coating portion 3A is formed on the entire area of the first thermally sprayed coating formation region by lowering and raising the nozzle 4 through four round-trip passes. As a result, the first thermally sprayed coating portion 3A is uniformly deposited onto the first wall section of the cylinder bore 2 near the combustion chamber.

Next, as seen in FIGS. 5 and 6, the second wall section of the cylinder bore 2 where the piston slides (sliding section) is sprayed. More specifically, the second thermally sprayed coating portion 3B is formed by spraying molten metal droplets onto the second wall (sliding) section of the cylinder bore 2 spanning from the bottom end position of the first thermally sprayed coating portion 3A to the lower end of the cylinder bore 2. As seen in FIG. 5, molten metal droplets is sprayed onto the sliding section of the internal wall 2*a* while the nozzle 4 is simultaneously rotated and lowered downward toward a bottom end position of the cylinder bore 2 from the bottom end position of the first thermally sprayed coating portion 3A. As seen in FIG. 6, when the nozzle 4 reaches the bottom end position of the cylinder bore 2, the feed direction of the nozzle 4 is reversed and molten metal droplets are sprayed onto the sliding section of the internal wall 2*a* while the nozzle 4 is simultaneously rotated and raised upward toward the entrance opening of the cylinder bore 2.

The stroke length through which the nozzle 4 is moved when spraying the sliding section of the cylinder bore 2 (i.e., forming the second thermally sprayed coating portion 3B) is longer than the stroke length through which the nozzle 4 is moved when spraying the section near the combustion chamber (i.e., forming the first thermally sprayed coating portion 3A). The stroke length used when forming the second thermally sprayed coating portion 3B is, for example, approximately six times longer than the stroke length used when forming the first thermally sprayed coating portion 3A, i.e., 120 mm. With the stroke length of the nozzle 4 set to 120 mm, the second thermally sprayed coating portion 3B is formed on the entire area of the second thermally sprayed coating formation region by lowering and raising the nozzle 4 through four round-trip passes. As a result, the second thermally sprayed coating 3A is uniformly deposited onto the sliding section of the cylinder bore 2. The speeds of rotating and reciprocating the nozzle 4 are the same for coating both the first and second thermally sprayed coating portions 3A and 3B.

In this embodiment, the internal wall 2*a* of the cylinder bore 2 is divided into upper and lower wall sections and droplets of molten metal are sprayed onto each of the wall sections. Since the concentration of an iron oxide contained in the thermally sprayed coatings formed on each of the wall sections (i.e., the first thermally sprayed coating portion and the second thermally sprayed coating portion) is different, the coating formed on each of the wall sections can be endowed with an optimum concentration of the iron oxide. More specifically, the first thermally sprayed coating portion 3A formed on a section of the cylinder bore 2 near a combustion chamber can be made to have a lower iron oxide concentration in order to obtain a higher inter-layer adhesion strength, and the second thermally sprayed coating portion 3B formed on the sliding section of the cylinder bore 2 can be made to have a higher iron oxide concentration of to obtain a better sliding performance.

When the feed stroke length through which the nozzle 4 is moved inside the cylinder bore 2 is changed (different), the amount of time from when a particular droplet of molten metal is sprayed onto the internal wall 2*a* until that droplet is covered by another droplet of molten metal is different. Consequently, the amount of time during which each droplet can oxidize before it is covered with another droplet is different. More specifically, the longer the stroke length of the nozzle 4 is, the more time each droplet of molten metal has to oxidize. Thus, the concentration of iron oxide contained in the first thermally sprayed coating portion 3A is lower because the stroke length of the nozzle 4 is shorter, and the concentration of iron oxide contained in the second thermally sprayed coating portion 3B is higher because the stroke length of the nozzle 4 is longer. As a result, the first thermally sprayed coating portion 3A (formed on the first wall section of the cylinder bore 2 near a combustion chamber) has a higher inter-layer adhesion strength, and the second thermally sprayed coating portion 3B (formed on the sliding section of the cylinder bore 2) has a higher sliding performance with respect to a piston due to the self-lubricating property of the iron oxide. Additionally, since the necessary performance properties can be imparted to the portion of the thermally sprayed coating 3 formed on each section of the cylinder bore 2 by simply changing the stroke length of the nozzle 4, the thermally sprayed coating 3 can be formed without the need to invest in expensive equipment or expensive modifications of equipment. As a result, an optimum concentration of the iron oxide can be imparted to the coating in each of the wall sections without the need to invest in expensive equipment or expensive modifications of equipment.

In accordance with one embodiment, the concentration of an iron oxide contained in the portion of the thermally sprayed coating 3 formed on each section of the internal wall 2*a* of the cylinder bore 2 is adjusted by changing a feed stroke length of the nozzle 4. Conversely, in accordance with another embodiment, the concentration of iron oxide contained in each portion of the thermally sprayed coating is adjusted by changing the composition of a gas that is blown when the molten droplets are sprayed from the nozzle 4.

For example, when the first thermally sprayed coating portion 3A is formed on the first wall section of the cylinder bore 2 near a combustion chamber, nitrogen gas is used as an assisting gas such that nitrogen gas is blown against the droplets of molten metal when the droplets are sprayed. Meanwhile, when the second thermally sprayed coating portion 3B is formed on the second wall (sliding) section of the cylinder bore 2 where a piston slides, air is used as an assisting gas such that air is blown against the droplets of molten metal when the droplets are sprayed.

When nitrogen gas is used as an assisting gas, it is more difficult for the molten metal droplets to oxidize. Consequently, the concentration of iron oxide contained in the first thermally sprayed coating portion 3A is lower. Conversely, when air is used as an assisting gas, it is easier for the molten metal droplets to oxidize and, consequently, the concentration of iron oxide contained in the second thermally sprayed coating portion 3B is higher.

It is acceptable for the method used in the second embodiment to be used either separately from or in conjunction with the method used in the first embodiment (in which the different portions of the thermally sprayed coating are formed using different stroke lengths of the nozzle 4). In other words, it is acceptable to form the different portions of the thermally sprayed coating using different feed stroke lengths of the nozzle 4 and different assisting gasses.

With the second embodiment, the concentration of iron oxide contained in the portion of the thermally sprayed coating formed on each section of the cylinder bore 2 can be adjusted by changing the composition of a gas that is blown when the molten droplets are sprayed from the nozzle 4.

In the second embodiment, nitrogen gas is blown when molten metal droplets are sprayed onto the section of the cylinder bore 2 located near a combustion chamber to form the first thermally sprayed coating portion 3A and air is blown when molten metal droplets are sprayed onto the section of the cylinder bore 2 where a piston slides (sliding section) to form the second thermally sprayed coating portion 3B. Thus, the concentration of iron oxide contained in the first thermally sprayed coating portion 3A is comparatively low and the concentration of iron oxide contained in the second thermally sprayed coating portion 3B is comparatively high. As a result, the first thermally sprayed coating portion 3A has an improved inter-layer adhesion strength with respect to the internal wall 2*a* of the section of the cylinder bore 2 located near the combustion chamber and an anti-knock property of the engine during combustion can be improved. Meanwhile, the second thermally sprayed coating portion 3B imparts an improved sliding performance to the siding section of the cylinder bore 2 due to the self-lubricating property of the iron oxide. As a result, an optimum concentration of the iron oxide can be imparted to the coating in each of the wall sections without the need to invest in expensive equipment or expensive modifications of equipment.

Figure 7:
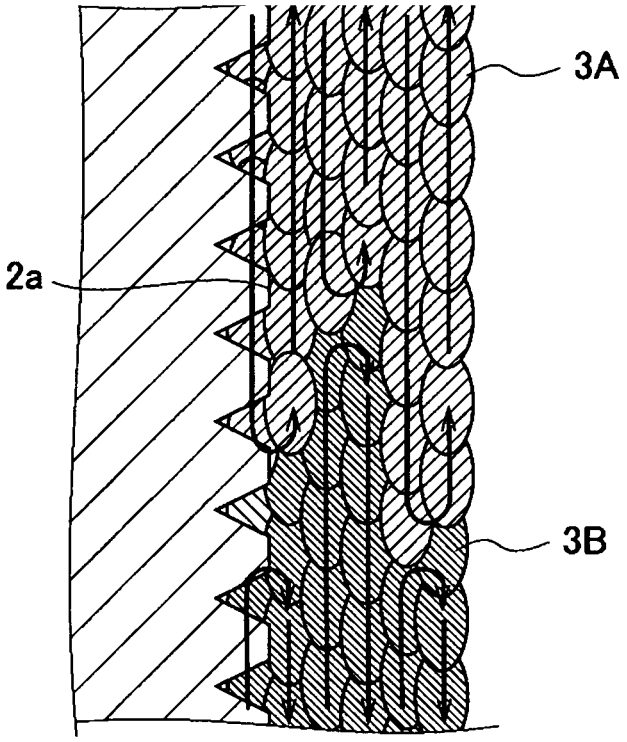
FIG. 7 is an enlarged cross sectional view of one of a cylinder bore of a cylinder block shown in FIG. 1 showing features of a thermally sprayed coating according to another embodiment.

FIG. 7 is an enlarged cross sectional view showing features of a thermally sprayed coating according to another embodiment. In this embodiment, the internal wall 2*a* of the cylinder bore 2 is divided into upper and lower (first and second) wall sections as in the prior embodiments shown in FIGS. 1 to 6, and the first and second thermally sprayed coating portions 3A and 3B are formed so as to partially overlap each other at a border portion where the two coatings meet. Other than changing the stroke length for applying the first and second thermally sprayed coating portions 3A and 3B so that they partially overlap each other, the process is the same as either of the two above mentioned processes.

More specifically, as indicated with the arrows shown in FIG. 5, the positions where the nozzle 4 changes directions (doubles back) while spraying the molten metal droplets at a bottom end portion of the first thermally sprayed coating portion 3A are slightly offset from one another. For example, a position where the nozzle 4 changes directions at the bottom end of the first thermally sprayed coating portion 3A during a second round-trip pass is shifted toward the inlet of the cylinder bore 2 with respect to a position where the nozzle 4 changed directions during a first round-trip pass. Similarly, a position where the nozzle 4 changes directions at the bottom end of a third round-trip pass is shifted toward the bottom end of the cylinder bore 2 with respect to the position where the nozzle 4 changed directions during the second round-trip pass.

Next, when the second thermally sprayed coating portion 3B is formed, the positions where the nozzle 4 changes directions (doubles back) while spraying the molten metal droplets are not constant but, instead, are slightly offset toward the entrance opening of the cylinder bore 2 during some passes. In this way, the second thermally sprayed coating portion 3B is made to enter into a portion of the first thermally sprayed coating portion 3A such that the two thermally sprayed coatings overlap each other.

Since the first thermally sprayed coating portion 3A and the second thermally sprayed coating portion 3B are intermeshed with each other at the portion where they are joined together, the inter-layer adhesion strength of the coatings with respect to the internal wall 2*a* of the cylinder bore 2 is further improved.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. The structures and functions of one embodiment can be adopted in another embodiment. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A thermally sprayed coating forming method comprising:

forming an upper thermally sprayed coating portion having a first iron oxide concentration on an upper wall section of an internal wall of a cylinder bore of a cylinder block by thermally spraying droplets of a molten metal on the upper wall section of an internal wall of a cylinder bore of a cylinder block; and forming a lower thermally sprayed coating portion having a second iron oxide concentration on a lower wall section of an internal wall of the cylinder bore of the cylinder block by thermally spraying droplets of a molten metal on the lower wall section of the internal wall of the cylinder bore of the cylinder block;

the forming of the upper and lower thermally sprayed coating portions being performed by moving a nozzle used to spray the droplets of the molten metal inside the cylinder bore with a varied feed stroke to make the first and second iron oxide concentrations in the upper and lower thermally sprayed coating portions different from each other.

2. The thermally sprayed coating forming method as recited in claim 1, wherein the second iron oxide concentration is higher than the first iron oxide concentration.

3. The thermally sprayed coating forming method as recited in claim 1, wherein during the forming of the upper and lower thermally sprayed coating portions, a composition of a gas, which is blown when the droplets of the molten metal are sprayed, is changed to make the first and second iron oxide concentrations in the upper and lower thermally sprayed coating portions different from each other.

4. The thermally sprayed coating forming method as recited in claim 3, wherein during the forming of the upper thermally sprayed coating portion, nitrogen gas is blown while the droplets of the molten metal are sprayed onto the upper wall section of the cylinder bore that is located near a combustion chamber, and during the forming of the lower thermally sprayed coating portion, air is blown while the droplets of the molten metal are sprayed onto the lower wall section of the cylinder bore where a piston reciprocates in a sliding motion.

5. The thermally sprayed coating forming method as recited in claim 4, wherein the forming of the upper and lower thermally sprayed coating portions are formed such the first and second thermally sprayed coating portions overlap each other at a border portion where the first and second thermally sprayed coating portions meet.

6. The thermally sprayed coating forming method as recited in claim 1, wherein during the forming of the upper and lower thermally sprayed coating portions, a composition of a gas, which is blown when the droplets of the molten metal are sprayed, is changed to make the first and second iron oxide concentrations in the upper and lower thermally sprayed coating portions different from each other.

7. The thermally sprayed coating forming method as recited in claim 6, wherein during the forming of the upper thermally sprayed coating portion, nitrogen gas is blown while the droplets of the molten metal are sprayed onto the upper wall section of the cylinder bore that is located near a combustion chamber, and during the forming of the lower thermally sprayed coating portion, air is blown while the droplets of the molten metal are sprayed onto the lower wall section of the cylinder bore where a piston reciprocates in a sliding motion.

8. The thermally sprayed coating forming method as recited in claim 7, wherein the forming of the upper and lower thermally sprayed coating portions are formed such the first and second thermally sprayed coating portions overlap each other at a border portion where the first and second thermally sprayed coating portions meet.

9. The thermally sprayed coating forming method as recited in claim 1, wherein the forming of the upper and lower thermally sprayed coating portions are formed such the first and second thermally sprayed coating portions overlap each other at a border portion where the first and second thermally sprayed coating portions meet.

10. The thermally sprayed coating forming method as recited in claim 2, wherein the forming of the upper and lower thermally sprayed coating portions are formed such the first and second thermally sprayed coating portions overlap each other at a border portion where the first and second thermally sprayed coating portions meet.

11. The thermally sprayed coating forming method as recited in claim 3, wherein the forming of the upper and lower thermally sprayed coating portions are formed such the first and second thermally sprayed coating portions overlap each other at a border portion where the first and second thermally sprayed coating portions meet.

12. The thermally sprayed coating forming method as recited in claim 2, wherein a longer feed stroke produces a higher iron oxide concentration and a lower feed stroke produces a lower iron oxide concentration.

13. The thermally sprayed coating forming method as recited in claim 1, wherein the forming of the upper thermally sprayed coating portion includes thermally spraying droplets of a molten metal on the upper wall section of the internal wall of the cylinder bore such that the first iron oxide concentration is a lower iron oxide concentration that has a higher inter-layer adhesion strength; and the forming of the lower thermally sprayed coating portion includes thermally spraying droplets of a molten metal on the lower wall section of the internal wall of the cylinder bore such that the second iron oxide concentration is a higher iron oxide concentration that has a higher sliding performance with respect to a piston that moves in the cylinder bore.

* * * * *